US005622125A

United States Patent [19]

Adamski, Jr. et al.

[11] Patent Number: 5,622,125

[45] Date of Patent: Apr. 22, 1997

[54] AUTOMATIC COVERSTITCH ON CIRCULAR GARMENT BANDS

[75] Inventors: Maximilian Adamski, Jr., Tega Cay, S.C.; Stephen S. Ruderman, Matthews, N.C.; Robert L. Kosrow, Hoffman Estates, Ill.

[73] Assignee: Union Special Corporation, Huntley, Ill.

[21] Appl. No.: 311,331

[22] Filed: Sep. 23, 1994

[51] Int. Cl.[6] ..... D05B 35/02; D05B 35/10

[52] U.S. Cl. ..... 112/63; 112/305; 112/306; 112/470.07; 112/475.03

[58] Field of Search ..... 112/475.02, 475.03, 112/475.04, 63, 153, 305, 306, 318, 322, 235, 272, 277, 470.03, 470.07, 470.29, 10

[56] References Cited

U.S. PATENT DOCUMENTS

| | | | |
|---|---|---|---|
| 4,159,687 | 7/1979 | Masuda et al. . | |
| 4,467,734 | 8/1984 | Rohr . | |
| 4,467,739 | 8/1984 | Hager et al. . | |
| 4,479,447 | 10/1984 | Rohr . | |
| 4,512,268 | 4/1985 | Rohr . | |
| 4,681,051 | 7/1987 | Kirch et al. . | |
| 4,682,553 | 7/1987 | Bachmann et al. . | |
| 4,744,319 | 5/1988 | Rohr . | |
| 4,823,716 | 4/1989 | Nakashima . | |
| 4,827,856 | 5/1989 | Rohr . | |
| 4,827,858 | 5/1989 | Horie et al. . | |
| 4,836,119 | 6/1989 | Siraco et al. . | |
| 4,883,005 | 11/1989 | Wehmeyer | 112/63 |
| 4,998,493 | 3/1991 | Takafumi . | |
| 5,029,541 | 7/1991 | Rohr et al. . | |
| 5,103,749 | 4/1992 | Geisselmann . | |
| 5,188,047 | 2/1993 | Rohr et al. . | |
| 5,251,557 | 10/1993 | Rohr . | |
| 5,269,239 | 12/1993 | Adamski, Jr. et al. | 112/306 X |
| 5,269,257 | 12/1993 | Yamazaki | 112/475.03 X |
| 5,271,347 | 12/1993 | Fontcuberta | 112/475.03 |

FOREIGN PATENT DOCUMENTS

| | | |
|---|---|---|
| 62-94195 | 4/1987 | Japan . |

*Primary Examiner*—Peter Nerbun
*Attorney, Agent, or Firm*—Brinks Hofer Gilson & Lione

[57] ABSTRACT

A sewing machine in combination with a workpiece control and advancing mechanism for automatically forming a coverstitch over an existing overedge stitch. The workpiece control and advancing mechanism includes an edge sensor and an edge guider and a feed roller for stretching the garment to place the garment in a condition that it can be automatically processed.

15 Claims, 6 Drawing Sheets

AUTOMATIC COVERSTITCH ON CIRCULAR GARMENT BANDS

CROSS-REFERENCES

The present application is related to U.S. Pat. No. 5,251,557, entitled "SEWING MACHINE WITH AN EDGE GUIDING DEVICE TO GUIDE ONE OR MORE PLIES OF MATERIAL," that issued on Oct. 12, 1993, U.S. Pat. No. 4,467,734, entitled "AUTOMATIC APPARATUS FOR CONJOINTLY SUPPORTING AND GUIDING A TUBULAR WORKPIECE," that issued on Aug. 28, 1984, U.S. Pat. No. 4,479,447, entitled "METHOD AND APPARATUS FOR SEWING ON A TUBULAR WORKPIECE EDGE," that issued on Oct. 30, 1984, and U.S. Pat. No. 4,512,268, entitled "METHOD AND APPARATUS FOR TENSIONING AND SEWING A TUBULAR WORKPIECE," that issued on Apr. 23, 1985. These patents are hereby incorporated by reference in the subject application.

The present application is also related to U.S. Pat. No. 5,370,072, entitled "AUTOMATIC ALIGNMENT OF MATERIAL AND POSITIONING AT THE STITCH FORMING LOCATION," that issued on Dec. 6, 1994. This patent is hereby incorporated by reference in the subject application.

BACKGROUND OF THE INVENTION

This invention relates to a machine and method for automatically applying a coverstitch or topstitch over an overedge stitch that has been applied to a circular part of a garments such as the rib knit waist bands on a fleece sweat shirts. This coverstitch can also be applied over an overedge stitch on neck collars on both knit and fleece garments and sleeve arm holes on knit or fleece garments. The appearance of the overedge stitch on the outside of a garment is greatly enhanced by a coverstitch or topstitch. The coverstitch or topstitch also smooths out and reduces the height of the bulky overedge seam on the underside of the garment, thus adding to the comfort and quality of the garment. The coverstitch or topstitch of course also increases the strength and endurance of the seam connecting the garment pieces. The application of a coverstitch or topstitch has in the past been done manually by skilled sewing machine operators using machines to which has special coverstitch sewing parts were added. In this manual operation after the presser foot is lowered and sewing commences, the operator must carefully guide the overedge stitch throughout the entire sewing cycle to assure that the seam is always properly aligned. The manual operation is not ergonomically acceptable, is tedious and difficult even for experienced operators and of course add considerable cost to the production of quality garments.

The manual operation requires the operator to slow down the stitching speed as the end of sew approaches so that stitching can be stopped at the beginning of the seam and prevent excessive over-stitching. This slows the manual operation.

For the foregoing reasons, there is a need for a machine that automatically guides a garment, having a circular overedge seam attaching pieces such as the waist bands on the bottom edge of the shirt body, while applying a coverstitch over the circular overedge seam.

SUMMARY OF THE INVENTION

The present invention is directed to a machine and method that satisfies these needs. The sewing machine used in this invention, for example a Union Special 93800BHA Automatic Bottom Hemmer, produces a two needle three thread bottom coverstitch such as a 406EFa-1 stitch. This invention enables the operator to place garment under the presser foot in the general range or area of the throat plate groove and the machine then automatically aligns the seam before the presser foot lowers and sewing commences. During the entire sewing cycle the seam is automatically aligned and the operator is relieved of the tedious and fatiguing task of manually guiding the seam. Finally the garment is automatically removed from the sewing machine and stacked.

The present invention permits the garment to be loaded in a relaxed state after which it is automatically stretched or tensioned. An edge guider is used to provide automatic dynamic edge guidance to the tensioned marginal edge of the garment during the sewing cycle. A seam sensor is provided that senses the return of the beginning seam and automatically stops the sewing cycle to prevent excessive over stitching.

Some aspects of this invention can also be applied to improving a manual workstation and will improve the quality and increase productivity. In applying improvements of this invention to a manual work station the concept of automatic seam detection is used which will assure consistent end of sew and will eliminate the need for the operator to slow down the stitch rate at the end of sew.

For the foregoing reasons there is a need for a machine that minimizes the time required and the stress placed on an operator while automatically producing a superior coverstitch over a circular overedge seam such as the seam connecting a waist band to a shirt body.

DETAILED DESCRIPTION OF THE PREFERRED EMBODIMENT

Figure 1:
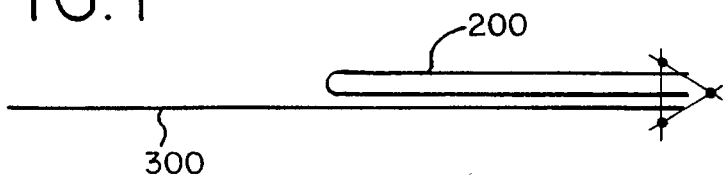
FIG. 1 is a symbolic cross section representation of a circular waist band or collar sewn to a shirt body with an overedge stitch.
Figure 2:
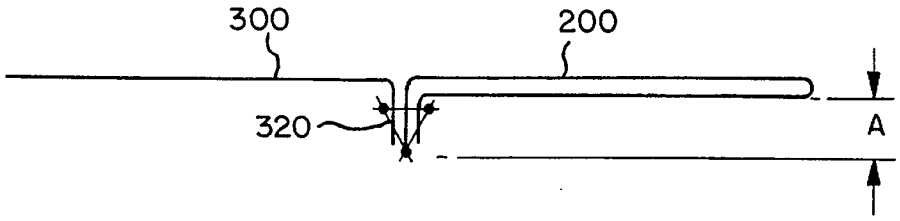
FIG. 2 is another view of the waist band or collar of FIG. 1 after it has been opened up illustrating the bulky overedge seam on the inside of the garment.
Figure 3:
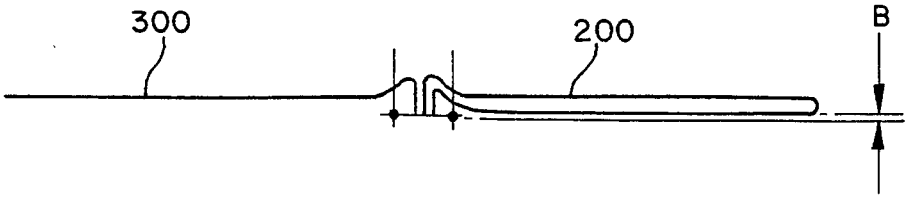
FIG. 3 is a symbolic cross section representation of the waist band or collar of FIGS. 1 and 2 after the coverstitch has been applied.

FIGS. 1 is a symbolic cross section representation of a circular waist band 200 or collar sewn to a shirt body 300 with an overedge stitch. In FIG. 2 the shirt body 300 and waist band 200 has been opened up and the bulky overedge seam 320, represented by the distance A, is seen on the inside surface of the garment. FIG. 3 is a symbolic cross section representation of the shirt body 300 and waist band 200 or collar of FIGS. 1 and 2 after the coverstitch has been applied. In FIG. 3 the overedge stitch has been compressed by the coverstitch and its height is represented by the distance B.

Figure 4:
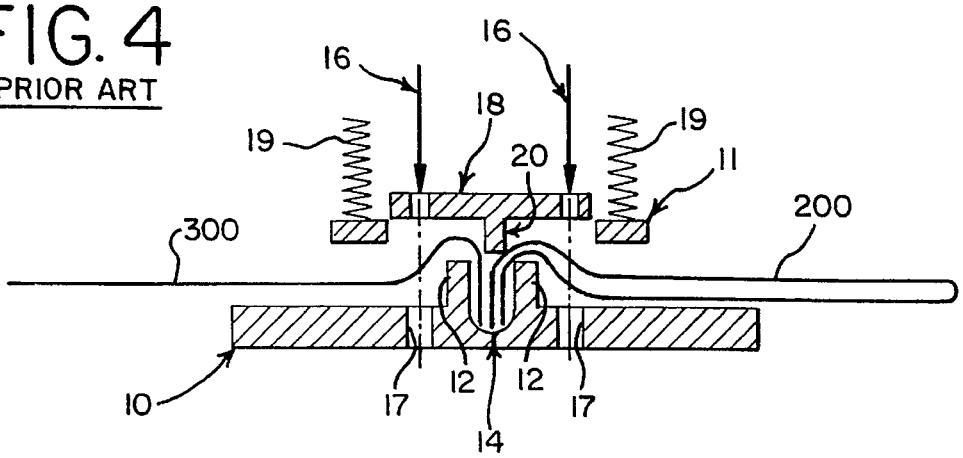
FIG. 4 PRIOR ART
FIG. 4 is a cross section view of the prior art coverstitch accessory parts.

FIG. 4, which has been labeled PRIOR ART is a cross section view of the accessory parts that are currently attached to a sewing machine and used to produce a coverstitch over an overedge seam. The throat plate 10 has a pair of raised ridges 12 between which is formed an overedge seam guide groove 14. The overedge seam guide groove 14 extends in the direction of material feed. The throat plate 10 also has needle apertures 17 formed therein through which needles 16 reciprocate. The presser foot 18, that has a seam guide keel 20 extending from its bottom surface, that overlies the throat plate 10 such that the seam guide keel 20 extends into the overedge seam guide groove 14. The presser foot 18 also includes sections 11 that are biased down by springs 19.

When manually producing a coverstitch over an overedge seam the operator loads the overedge seam into the overedge seam groove 14 as is shown in FIG. 4. The operator then lowers the presser foot 18 and initiates the sewing operation. During this entire sewing operation the operator must manually maintain the seam guide keel 20 in the valley of the overedge seam and the overedge seam in the overedge seam guide groove 14. It should be noted that since the coverstitch is applied to the outer surface of the garment the seam guide keel 20, overedge seam and the overedge seam guide groove are not visible to the operator and thus this guiding operation must be done by feel. Also when performing the manual operation the operator must slow the sewing speed as the beginning of the coverstitch approaches so that sewing can be accurately stopped at the beginning of the coverstitch seam.

Figure 5:
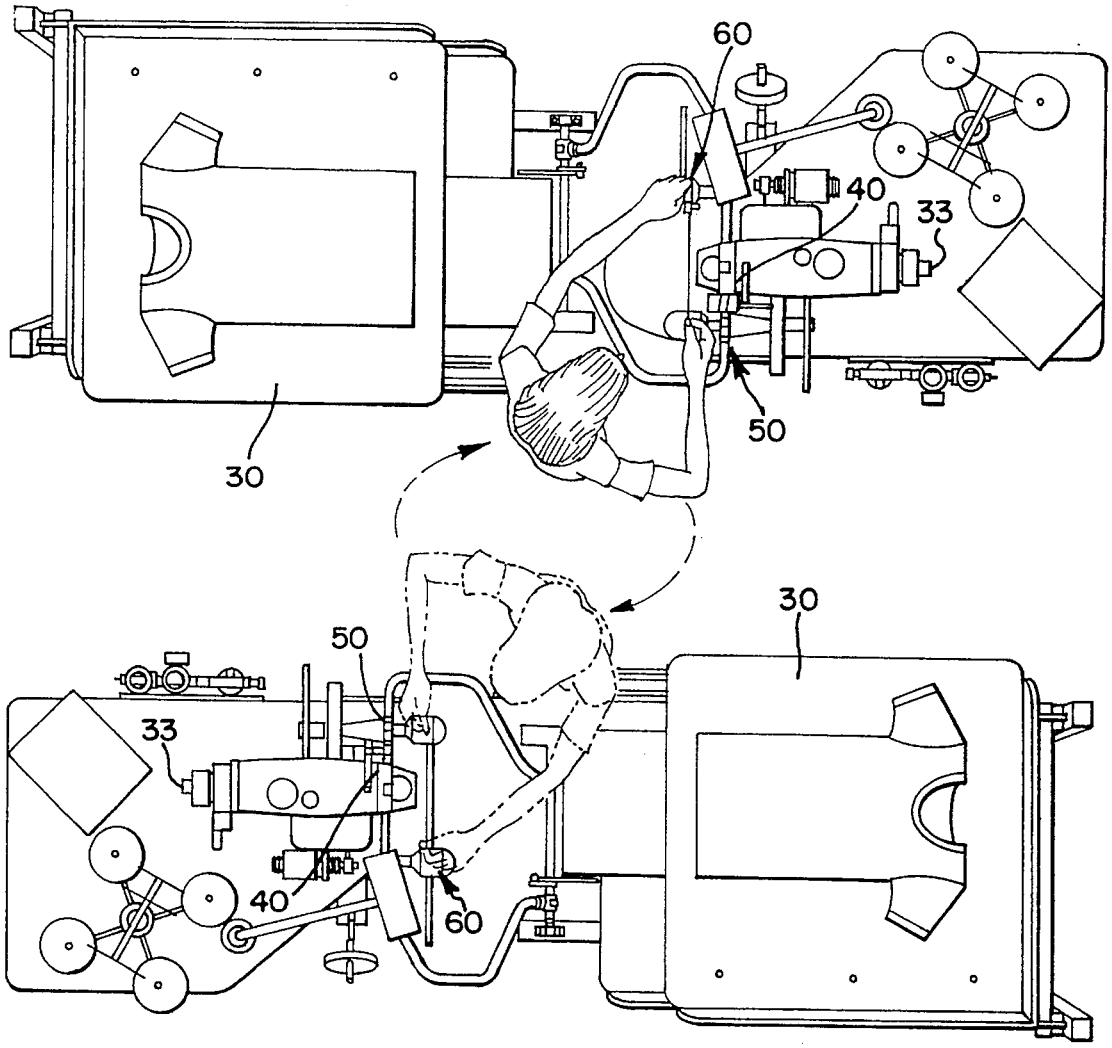
FIG. 5 is a plan view of the system including the stacker mechanism and an operator.

In FIG. 5 two work stations that are equipped to perform this automatic operation are shown in plan view. In this view the sewing machine 32, the workpiece control and advancing mechanism 60 and the stacking mechanism 160 are shown. A shaft encoder 33 that is connected to the sewing machine shaft is shown in this Figure. The seam aligning roller 40, front feeding edge guider 50 and rear feed roller 62 are seen at each work station, all of which are components of the workpiece control and advancing mechanism 60. In this arrangement an operator can load one machine and initiated the automatic sew cycle. While the first machine is performing the automatic sew cycle the operator can turn around and load the second machine and initiate its automatic sew cycle.

Figure 6:
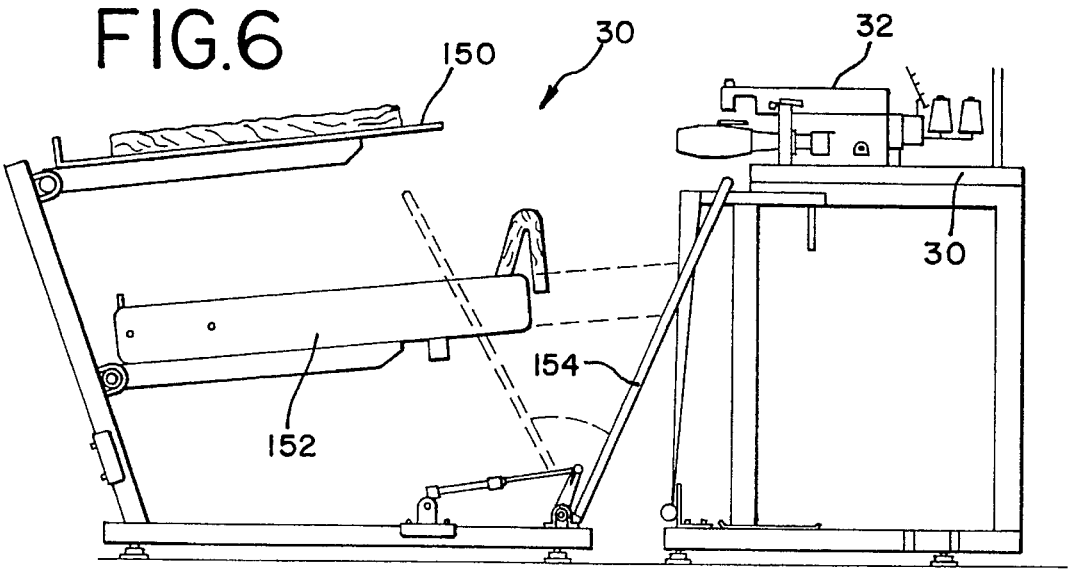
FIG. 6 is an end view of the sewing machine, frame and the stacking mechanism.

FIG. 6 is an end view of the sewing machine 32, stacking mechanism 160 and frame 30. The stacking mechanism includes an upper stacker tray 150 upon which the shirt bodies 300 are stored before application of the coverstitch and a lower stacker tray 152 upon which the shirt are stacked after the coverstitch has been applied. The stacking mechanism also includes a stacker pivot arm 154 that is pivotally mounted at its lower end and swings from its standby position, shown in full lines, through an arc of about 45 degrees. The lower stacker tray 152 is extended toward the completed shirt body to the location shown in broken lines. When lower stacker tray 152 reaches this location the stacker pivot arm 154 rotates toward the lower stacker tray 152 and deposits the sewn shirt on tray 152. The stacker pivot arm 154 then returns to its standby position.

Figure 7:
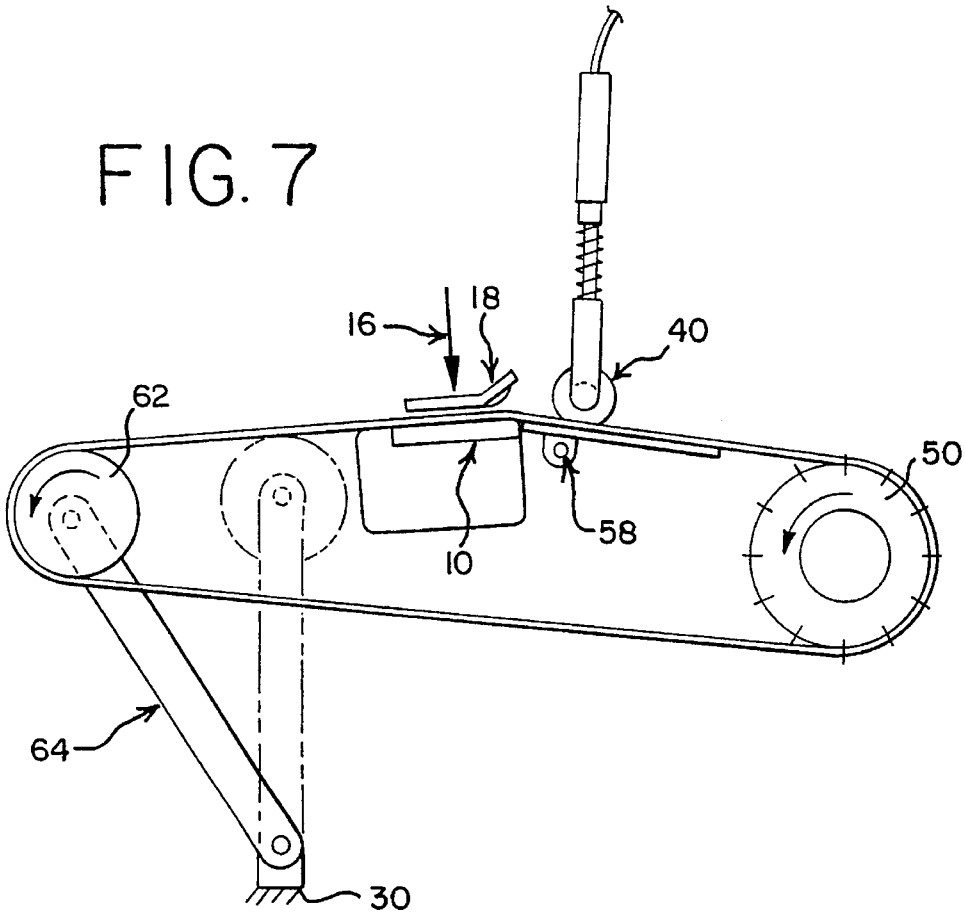
FIG. 7 is a side view of the mechanism of this invention with the garment loaded and prepared for the sew cycle.
Figure 8:
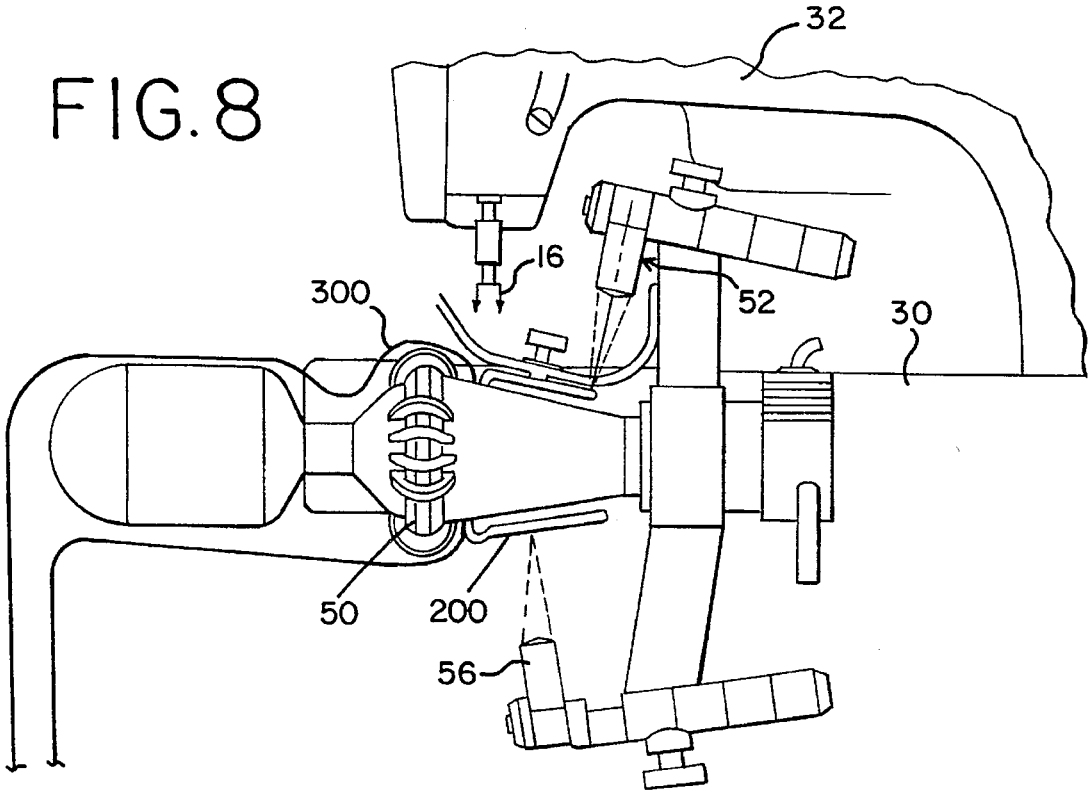
FIG. 8 is a front view of the machine with the garment loaded and showing the upper edge guider sensor and lower material presence sensor.

Referring now to FIGS. 7 and 8 the workpiece control and advancing mechanism 60 will be discussed. The sewing machine 32 and workpiece control and advancing mechanism 60 are electronically connected to a microprocessor 80 which the operator can program through its control panel 82. The sewing machine 32 and the workpiece control and advancing mechanism 60 are mounted on a frame 30. The workpiece control and advancing mechanism 60 includes a front feeding edge guider 50 and a rear feed roller over which the garment is loaded. As best seen in FIG. 7 the rear feed roller 62 is carried at the end of a tensioning arm 64 that is pivoted to the frame 30 at its other end. The garment is loaded over the front feeding edge guider 50 and the rear feed roller 62 with the rear feed roller 62 in its retracted position (shown in broken lines in FIG. 7). When the rear feed roller 62 is in this retracted position the garment can be easily loaded by the operator with out the need to physically stretch the garment. The rear feed roller 62 is power driven and when it is in its extended position and its drive is actuated it functions to pull the garment through the stitch area of the sewing machine 32. As will be further discussed the rear feed roller 62 is automatically moved from its retracted position to its expanded position (shown in full lines in FIG. 7) and power driven at the appropriate time in the cycle. The rear feed roller 62 is under the control of the microprocessor 80. When the rear feed roller 62 is in its expanded position the garment has been stretched and in this stretched condition it can be controlled by the workpiece control and advancing mechanism 60.

Although the front feeding edge guider 50 has a different outward configuration than the prior art edge guiders disclosed in the referenced U.S. Patents it functions in the same manner. The Function of the prior art edge guiders will be discussed with reference to FIGS. 14 and 15. Front feeding edge guider 50 functions in cooperation with front feeding edge guider sensor 52 seen in FIG. 8. Front feeding edge guider sensor 52 is a retro-reflective type sensor which emit rays that are reflected back to the sensor. The emitted rays are directed at a highly reflective surface, or a surface to which reflective tape has been applied. When the garment material moves into the area where the rays are directed there is a change in the rays that are reflected back to the sensor. This change is detected by the sensor and the change is transmitted to the microprocessor 80. The terms "margin edge" when used in this patent means the edge of the material that extends along the direction of material feed. The front feeding edge guider sensor 52 as disclosed herein is sensing the margin edge of the waist band 200.

The presser foot with seam keel 18, grooved throat plate 10, fiber optic seam detector 58, spring biased seam alignment roller 40 and its air cylinder 42, which are shown in FIG. 7, will be described in more detail with reference to FIGS. 9 and 10.

A portion of the sewing machine 32, workpiece control and advancing mechanism 60 and frame 30 are shown in FIG. 8 looking from the front of the sewing machine 32 in the direction of feed. The front feeding edge guider sensor 52 and the lower material present sensor 56 are seen in this view. The functions of sensors 52 and 56 will be discussed in more detail in a later portion of the specification.

Figure 9:
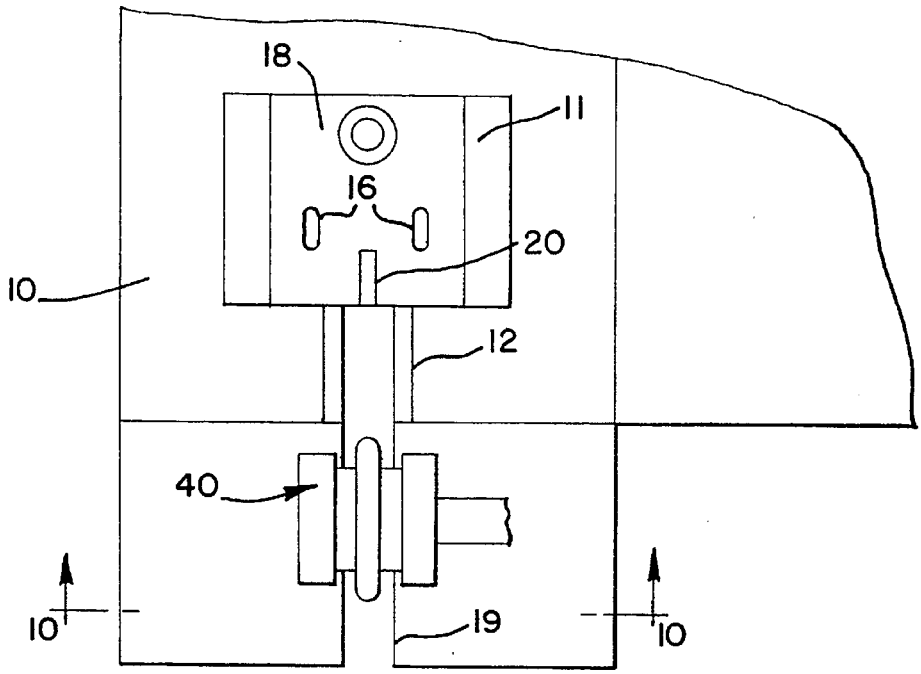
FIG. 9 is a top view of the presser foot seam groove and guides and the seam alignment roller.

FIG. 9 is a top view from above the presser foot with seam keel 18 and the spring biased seam alignment roller 40. The grooved throat plate 10 including the biased sections 11 overlay the grooved throat plate 10. The raised ridges 12 that underlay the presser foot with seam keel 18 extend past the front edge of the presser foot to the cloth support plate 15.

Figure 10:
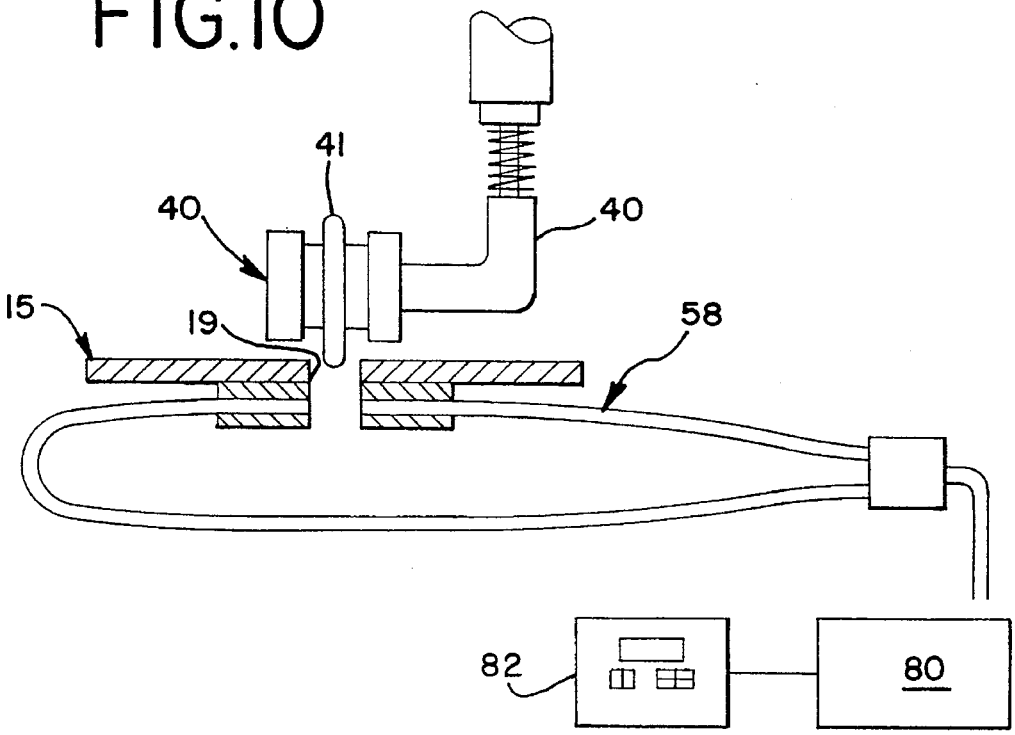
FIG. 10 is a view taken in the direction of lines 10—10 of FIG. 9.

As seen in FIG. 10 the spring biased seam alignment roller 40 overlays the cloth support plate 15 and its roller keel 41 is aligned with a guide slot 19 formed in the support plate 15. The spring biased seam alignment roller 40 can be raised and lowered by an air cylinder 42. The air cylinder 42 is automatically energized at the proper time in the cycle by the microprocessor 80. A fiber optics seam detector 58 is secured to the under surface of the cloth support plate 15 such that its beam spans the guide slot 19. The beam of the fiber optics seam detector 58 is spaced at a level below the upper surface of the cloth support plate 15 such that it will be interrupted by the bulky seam 320 before the coverstitch has compressed it. After the bulky seam 320 has been compressed by the coverstitch the beam of the fiber optics seam detector 58 passes uninterrupted below the seam. The fiber optics seam detector 58 is electrically connected to the microprocessor 80 and the presence of the coverstitch is transmitted to the microprocessor 80 when the beam of the fiber optics seam detector 58 is no longer interrupted by the bulky seam 320.

Figure 11:
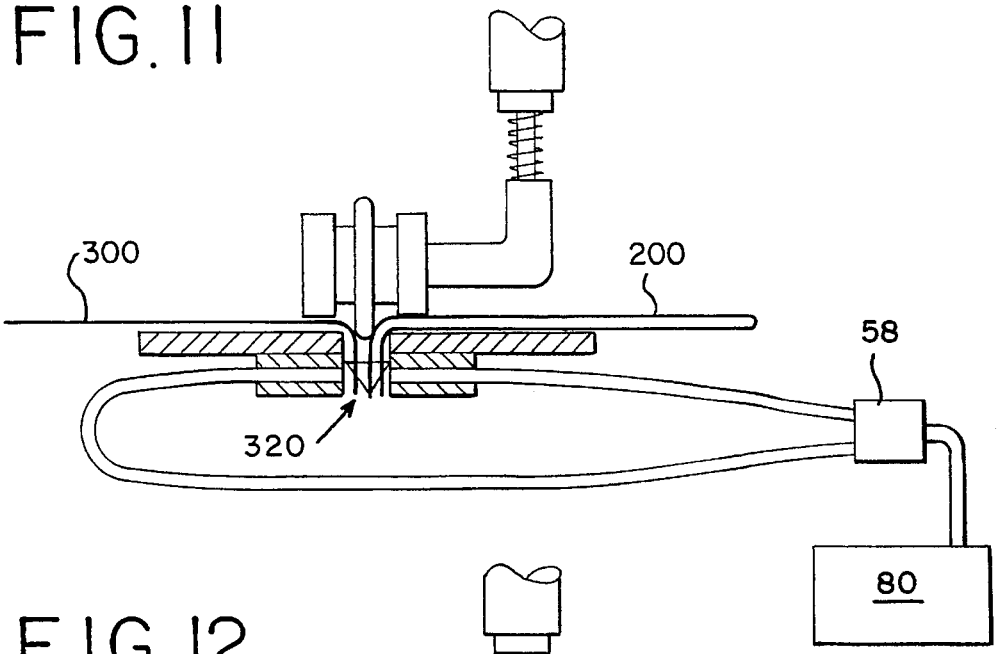
FIG. 11 is a view similar to FIG. 10 with the overedge seam before the coverstitch has been applied.

FIG. 11 is a view similar to FIG. 10 in which the waist band 200, shirt body 300 and the bulky seam 320 are shown in the gap formed by the fiber optics seam detector 58 and thus preventing the beam from crossing the gap.

Figure 12:
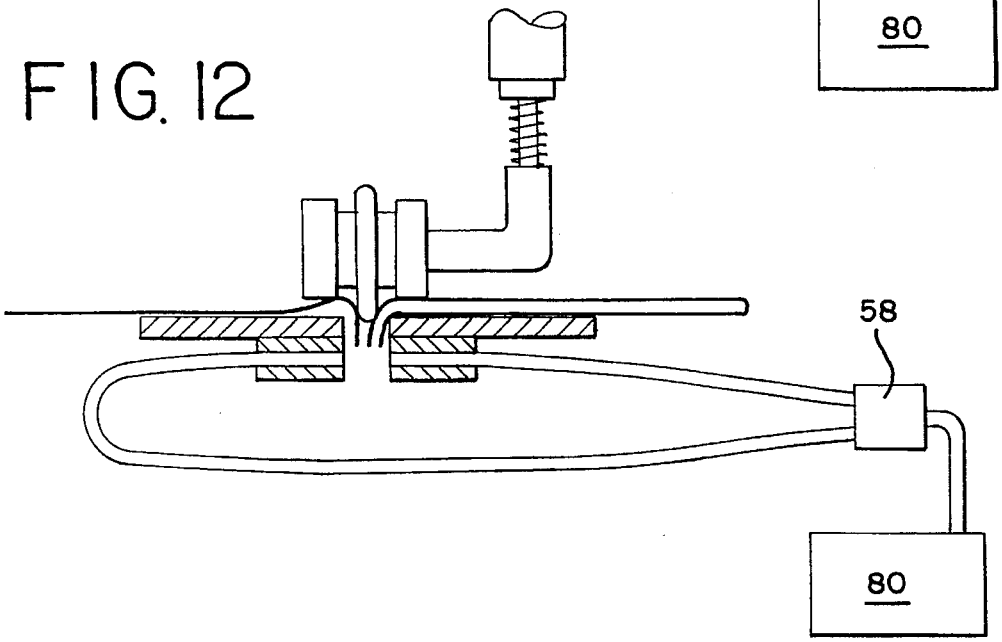
FIG. 12 is a view similar to FIG. 10 with the overedge seam after the coverstitch has been applied.

FIG. 12 is a view similar to FIGS. 10 and 11 in which the bulky seam 320 has been covered by the coverstitch and the beam from the fiber optics seam detector 58 can pass below the seam.

The spring biased seam alignment roller 40, cloth support plate 15 and fiber optics seam detector 58 can be used with the prior art grooved throat plate 10 and presser foot with seam keel 18 as an improved manual machine for applying a coverstitch over an overedge seam. When these components of applicants invention are used as a manual machine the front feeding edge guider 50 and rear feed roller 62 are not used. In the improved manual machine the spring biased seam alignment roller 40 functions to greatly assist the operator in maintaining alignment of the coverstitch over the overedge stitch and the fiber optics seam detector 58 functions to automatically stop sewing at the proper time and place without the need for the operator to slow the sewing operation.

Figure 13:
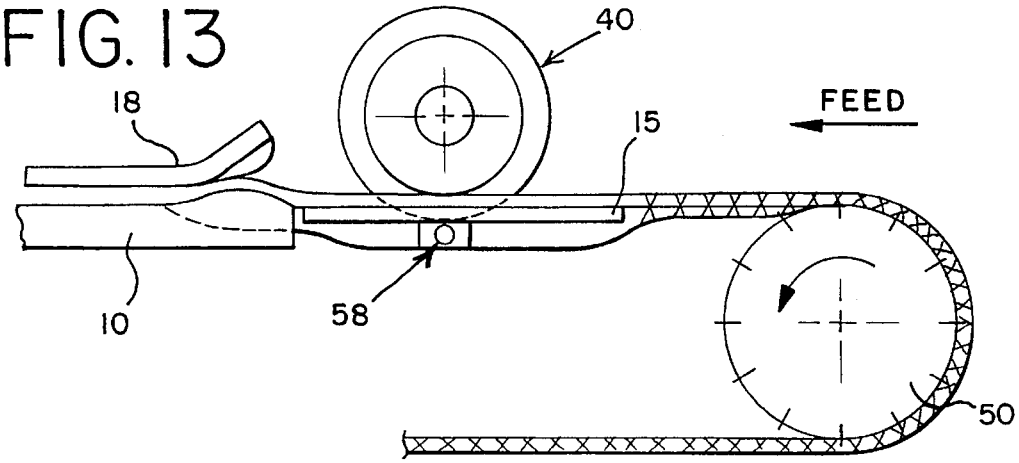
FIG. 13 is a side view of the machine with the garment approaching the end of the sewing operation.

FIG. 13 is a side view of the presser foot with seam keel 18, spring biased seam alignment roller 40, fiber optics seam detector 58 and the front feeding edge guider 50. In this view the bulky seam 320 without the coverstitch is shown under the presser foot with seam keel 18 and spring biased seam alignment roller 40. The bulky seam 320 is shown in a location where it is blocking the fiber optics seam detector 58. The garment section that is wrapped around the front feeding edge guider 50 has had the coverstitch applied and the beginning of the coverstitch seam is approaching the support plate 15. It is apparent from this view that when the coverstitch seam reaches the beam of the fiber optics seam detector 58 the beam will pass below the seam and the presence of the coverstitch seam will be communicated to the microprocessor 80.

Figure 14:
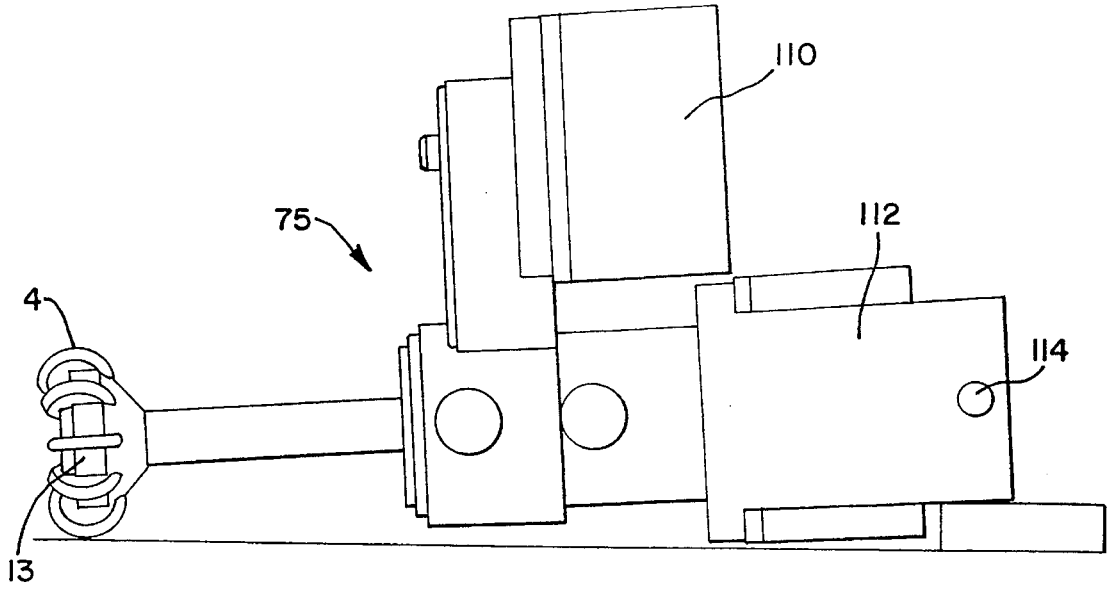
FIG. 14 is a side view of an edge guiding device of the type used in the automatic ply aligning and positioning mechanism of this invention.

Referring now to FIG. 14 which shows a prior art edge guider device of the type more fully disclosed in the above identified U.S. Pat. Nos. 5,251,557, 4,467,734, 4,479,447, 4,515,268 and pending application Ser. No. 08/123,000, is illustrated. The edge guider 75 has a first stepper motor 110 for driving the feeding wheel 13 that functions to advance the ply of material in the material feed direction and a second stepper motor 112 for driving the gripper wheels 4 that function to move the ply of material normal to the material feed direction. The stepper motors 110 and 112, can be controlled to rotate a specific number of rotations or fraction of a rotation. Thus, depending upon the diameter of the drive element and the drive ratios, a ply of material can be advanced a specific distance upon transmitting an actuation instructions to the stepper motor to run a specific number of steps in synchronization with sewing speed or feed.

Figure 15:
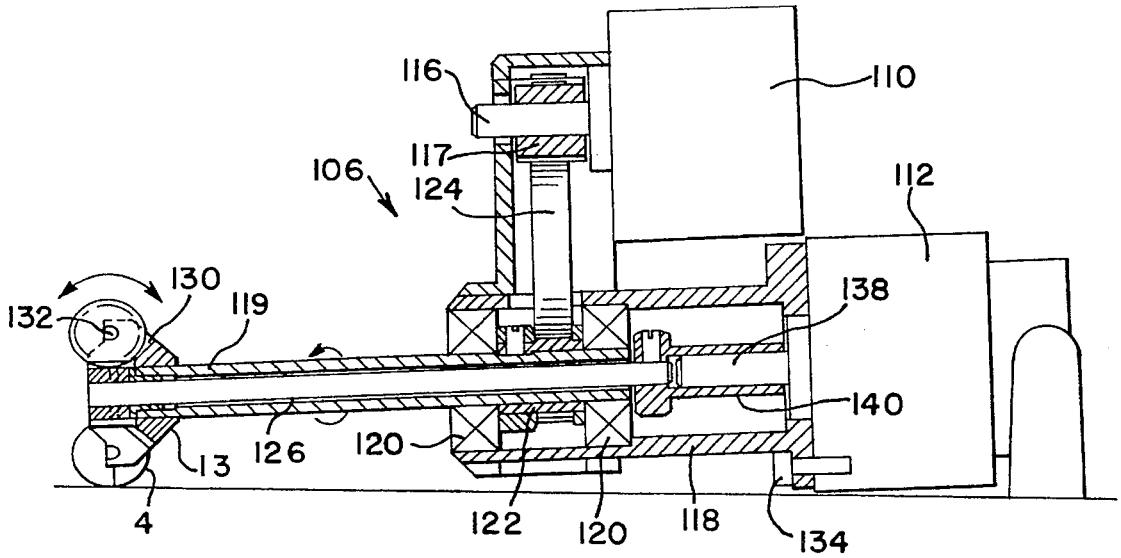
FIG. 15 is a cross section view of the edge guiding device seen in FIG. 14.

FIG. 15 is a cross section view of the body edge guider 75 seen in FIG. 14. A housing 118 has the first stepper motor 110 mounted to its outer surface. First stepper motor 110 has an output shaft 116 with a pinion 117 secured thereto. A hollow shaft 119 is mounted for rotation by bearings 120 in the housing 118 and has a pinion 122 secured thereto. Pinion 122 is mechanically connected by way of a toothed belt 124 to pinion 117. Rotary drive is transmitted from stepper motor 110 through toothed belt 124 to the hollow shaft 119. A feeding wheel 13 is fixed to the free end of hollow shaft 119 and thus rotates therewith. The feeding wheel 13 has a plurality of openings 130 formed therein in which gripper wheels 4 are mounted for rotation on shafts 132. The peripheral edges of gripper wheels 4 are in driving engagement with worm gear 128 and are caused to rotate thereby. Worm gear 128 is secured to the free end of shaft 126 that is mounted for rotation within the hollow shaft 119.

The housing 118 is secured to one end of second stepper motor 112 by bolts 134. The output shaft 138 of second stepper motor 112 is secured to shaft 126 by a coupler 140. The feeding wheel 13 of body edge guider 62 can be lifted off ply separator plate 143 by pivoting the edge guider 75 upwardly about shaft 114.

The following sequence occurs in the automatic process for applying a coverstitch over an overedge stitch:

1. The operator manually loads the garment on the machine.

2. The seam is manually loaded under the presser foot with seam keel 18. Accurate placement into the overedge seam guide groove 14 is not necessary.

3. As the garment is loaded the waist band 200 covers the lower material present sensor 56.

4. After a short programmable time delay, the seam guide roller 40 drops down on to the garment and the tensioning arm 64 and rear feed roller 62 expand the garment.

5. After a short programmable time delay, the front feeding edge guider 50 and rear feed roller 62 are activated and pull the seam in line with the overedge seam guide groove 14 and with the groove 19 in the cloth support plate 15.

6. After a short programmable time duration, the front feeding edge guider 50 and rear feed roller 62 stop, the spring biased seam alignment roller 40 is retracted and the presser foot with seam keel 18 drops on to the seam. The spring biased seam alignment roller 40 can remain down during the sewing operation.

7. After a short programmable time delay, the sewing machine 32, front feeding edge guider 50 and rear feed roller 62 are activated.

8. As the start of the coverstitch seam approaches the end of sewing, the fiber optic seam detector 58 is uncovered.

9. Uncovering the seam detector starts a stitch count to allow the sewing to continue to properly complete the coverstitch. A shaft encoder on the sewing machine sends pulses to the microprocessor 80 to start the end of sew count down.

10. After the programmable stitch count is reached, the sewing stops.

11. After a short programmable time delay, the threads are cut.

12. After a short programmable time delay, the presser foot 18 is raised.

13. The stacker 30 is activated and the garment is removed from the machine and is stacked.

All of the parameters such as speeds, delay periods, time periods, stitch counts and encoder pulse numbers that go into the automatic operation can be changed and are programmable through the microprocessor control panel 82. This is a very important feature of this machine since it allows the machine to be used for all sizes and numerous styles of apparel.

While the invention has heretofore been described in detail with particular reference to illustrated apparatus, it is to be understood that variations, modifications and the use of equivalent mechanisms can be effected without departing from the scope of this invention. It is, therefore, intended that such changes and modifications be covered by the following claims.

What is claimed is:

1. A sewing machine in combination with a workpiece control and advancing mechanism and processor that can automatically control the sewing machine and the components of the workpiece control and advancing mechanism, said sewing machine including stitch forming instruments for forming a coverstitch over an existing overedge stitch in a tubular workpiece that has a stitch line a predetermined distance from a marginal edge of the tubular workpiece, a frame, said sewing machine and said workpiece control and advancing mechanism mounted on said frame, said workpiece control and advancing mechanism maintaining and controlling the marginal edge of the tubular workpiece and maintaining said marginal edge a predetermined distance from said stitch line as the tubular workpiece advances toward said stitch forming instruments, said workpiece control and advancing mechanism comprising:

an edge guider sensor;

a front feeding edge guider for supporting the tubular workpieces at a location in advance of said stitch forming instruments and advancing the tubular workpiece in the direction of feed and in response to said edge guider sensor maintaining the tubular work pieces at a predetermined distance from the stitch line; and a rear feed roller that supports said tubular workpieces at a location following said stitch forming instruments.

2. The invention as set forth in claim 1, wherein said rear feed roller is mounted on said frame such that it can be moved toward and away from said front feeding edge guider in a direction along the stitch line such that said tubular workpieces can be loaded as a relaxed band on said front feeding edge guider and said rear feed roller and then stretched to an expanded state when said rear feed roller is moved away from said front feeding edge guider.

3. The invention as set forth in claim 1, the invention also includes a support plate having a groove formed therein along the stitch line.

4. The invention as set forth in claim 1, wherein the invention further includes a spring biased seam alignment roller for guiding said existing overedge seam into said groove formed in the support plate.

5. The invention as set forth in claim 1 in which an edge sensor sends a signal to said processor whenever it changes from sensing an edge to not sensing an edge or from not sensing an edge to sensing an edge, and said microprocessor sends a signal to the corresponding edge guider to reverse its direction of feed in response to the signal from the sensor.

6. The invention as set forth in claim 1 wherein said sewing machine includes an encoder that transmits pulses to the said microprocessor for each stitch produced by the sewing machine and said microprocessor uses these pulse to synchronize the speed of said front feeding edge guider and rear feed roller with the speed of the sewing machine.

7. The invention as set forth in claim 1 wherein said workpiece control and advancing mechanism includes:

a seam detector for detecting the beginning of said coverstitch and transmitting a signal to said processor indicating the location of the beginning of said coverstitch;

said processor, in response to receiving this signal from said seam detector, sends a signal that will stop the sewing when the beginning of the coverstitch reaches the stitch forming mechanism.

8. The invention as set forth in claims 7, wherein said seam detector is a fiber optics seam detector.

9. The invention as set forth in claim 1 wherein said processor can be programmed for the particular size and style of the workpiece.

10. The invention as set forth in claim 5 wherein said sewing machine includes an encoder that transmits a pulse to the said microprocessor for each stitch produced by the sewing machine and said microprocessor uses this stitch pulse to synchronize the speed of said edge guiders with the speed of the sewing machine.

11. A method for producing a coverstitch over an existing overedge stitch on a garment including a tubular workpiece using a sewing machine and workpiece control and advancing mechanism of the type in which the sewing machine includes stitch forming instruments including a presser foot with a seam keel, a cloth support plate having a groove formed therein and a spring biased seam alignment roller, wherein the workpiece control and advancing mechanism includes an edge sensor, an edge guider, a feeder, lower material present sensor, a seam guide roller, a front feeding edge guider, a rear feed roller and a fiber optic seam detector comprising the steps of:

(a). loading the garment on the machine, (b). loading the garment under the presser foot with a seam keel, (c). covering the lower material present sensor, (d). lowering the seam guide roller down on the garment, (e). expanding the garment, (f). activating the front feeding edge guider and rear feed roller, (g). pulling the overedge seam in line with the groove in the cloth support plate, (h). stopping the front feeding edge guider and rear feed roller, (i). retracting the spring biased seam alignment roller, (j). lowering the presser foot with a seam keel on the seam, (k). activating the sewing machine, front feeding edge guider and rear feed roller, and (l). uncovering the fiber optic seam detector.

12. The method as set forth in claim 11 wherein the following additional step is performed:

(m). stopping the sewing after a programmed stitch count.

13. The method as set forth in claim 12 wherein the following additional step is performed:

(n). raising the presser foot.

14. The method as set forth in claim 13 wherein the following additional step is performed:

(o). activating the stacker.

15. A sewing machine in combination with attachments for manually producing a coverstitch over an existing overedge seam;

said sewing machine includes stitch forming instruments for forming a coverstitch;

a throat plate, a presser foot that overlays said throat plate and includes a seam keel extending downwardly from its lower surface;

said presser foot including separate spring biased sections that press the workpiece against the throat plate;

said throat plate having a groove formed therein for reception of said seam keel;

a support plate secured to said sewing machine adjacent to said throat plate and having a groove formed therein along the stitch line;

a spring biased seam alignment roller mounted on said sewing machine over said support plate;

said seam alignment roller including a roller keel that is aligned with and rides in said groove formed in said support plate and guides said existing overedge seam into said groove formed in the support plate.

* * * * *